US007183939B1

(12) United States Patent
Lo et al.

(10) Patent No.: US 7,183,939 B1
(45) Date of Patent: Feb. 27, 2007

(54) SHINING FAN STRUCTURE FOR DISPLAYING IMAGES

(75) Inventors: Robert Lo, Taipei (TW); Chih-Ming Cheng, Taipei (TW)

(73) Assignee: ACT-Rx Technology Corporation, Taipei (TW)

( * ) Notice: Subject to any disclaimer, the term of this patent is extended or adjusted under 35 U.S.C. 154(b) by 0 days.

(21) Appl. No.: 11/313,915

(22) Filed: Dec. 22, 2005

(51) Int. Cl.
*G09F 13/00* (2006.01)

(52) U.S. Cl. ..... 340/815.53; 340/815.88; 362/540; 345/48; 345/42; 416/223 R

(58) Field of Classification Search ..... 340/815.4, 340/815.45, 815.53, 815.52, 815.55, 815.88; 362/540, 545, 549, 800; 345/30, 36, 39, 345/42, 44, 46, 48; 416/223 R, 244 R, 212 A, 416/212 R; 315/312, 316, 295, 362
See application file for complete search history.

(56) References Cited

U.S. PATENT DOCUMENTS

| | | | | |
|---|---|---|---|---|
| 2,559,831 | A * | 7/1951 | Roffy | 416/212 R |
| 6,166,496 | A * | 12/2000 | Lys et al. | 315/316 |
| 6,265,984 | B1 * | 7/2001 | Molinaroli | 340/815.4 |
| 7,150,549 | B2 * | 12/2006 | Olds et al. | 362/500 |
| 2003/0059307 | A1 * | 3/2003 | Moreno et al. | 416/142 |

* cited by examiner

*Primary Examiner*—Haissa Philogene

(57) ABSTRACT

A shining fan structure for displaying images of patterns or characters by reflection mainly includes a fan. A plurality of blades of the fan are provided with reflective patterns or characters. Light-emitting elements are provided on the periphery of the fan base. Each light-emitting element is angled to directly irradiate the front of the blade. When the fan rotates, the light-emitting elements provided on the periphery of the base irradiate the patterns or characters provided on the blades with the lightening frequency being synchronous with or different from the rotation speed of the fan, a shining effect can be seen from the front or side of the fan by reflection or transmission.

13 Claims, 4 Drawing Sheets

SHINING FAN STRUCTURE FOR DISPLAYING IMAGES

BACKGROUND OF THE INVENTION

1. Field of the Invention

The present invention relates to an improved fan structure, and in particular, to a fan structure having a shining effect.

2. Description of Prior Art

With the development of modern information technology, in addition to inherent functions of the electric products, manufacturers continuously update and improve the primary performance and additional functions, and even develop various multiple-function products so as to satisfy the demands of customers. Such kind of versatile products are available and striking in the market so as to attract the attention of the customers and cause them to purchase.

However, owing to the violent competition in the market, products and the functions thereof developed by each manufacture are substantially the same, and thus simple improvements in functions are not attractive enough to the customers. Therefore, since the most important demands of the customers are novelty, variation and distinctive features, all the manufactures start to change the originally monotonous and old-fashioned designs, and adopt shining appearances to attract the attention of young generation.

As a result, in view of the above concept, there are more and more computer casings having avant-garde styles everywhere in the market. Especially, a transparent casing by which the internal elements can be clearly seen has broken the traditional designs and raised a trend of transparency, causing all the manufactures to successively imitate this design. Thereafter, light-emitting elements (e.g. LED) are further arranged in the periphery of the computer casing or associated with other components (e.g. hard disc) to produce shining effect by using simple control circuits, which completely change the stiff and dull image of the electric products.

Under such a trend of breaking tradition, heat-radiating fans are also modified to change their inherent stiff designs. There are various kinds of structures in existing heat-radiating fans having light-emitting devices. For example, a conventional fan is provided with a light source in rear of the fan blades. When the blades are rotating, the light source can be blocked by the rotating blades, causing a twinkling visual effect. Further, in another conventional art, a plurality of light-emitting elements are incorporated into a soft circuit board, and then the circuit board is provided on each blade. A timing control circuit controller is provided to successively control each light-emitting element. When the blades rotate, predetermined patterns or characters can be displayed on the blades owing to the persistence of vision of human being.

In the above conventional art, the light-emitting elements are arranged according to predetermined patterns or characters, and positioned on the front or back of the blades. Next, by controlling with a circuit board, a shining effect can be produced. Further, the connected electrodes or circuits can be suitably hidden without affecting the aesthetic appearance of the heat-radiating fan. However, in order to suitably hide the electrodes or circuits, the production cost and complexity of the fan will be inevitably increased. Further, arranging the light-emitting elements on a base (e.g. blade) has to additionally mount a fixing base, which increases the total weight of the blades and affects the rotating performance of the heat-radiating fans. If the light-emitting elements are provided in front of the blades, connecting the electrodes directly to the front of the blades will affect the external appearance of the heat-radiating fan, and the exposed electrodes will easily interfere with the normal rotation of the blades. Thus, the conventional arts indeed have some problems.

SUMMARY OF THE INVENTION

In view of the above drawbacks, the present invention is to provide a shining fan structure for displaying patterns or characters by reflection. Various forms of patterns or characters made by reflective materials are provided on the blades, and light-emitting elements are provided on the fan base. With the lightening frequency being synchronous with or different from the rotation speed of the fan, fixed or movable patterns or characters can be displayed on the fan by reflection, thereby to produce a shining effect.

DETAILED DESCRIPTION OF THE INVENTION

Figure 1:
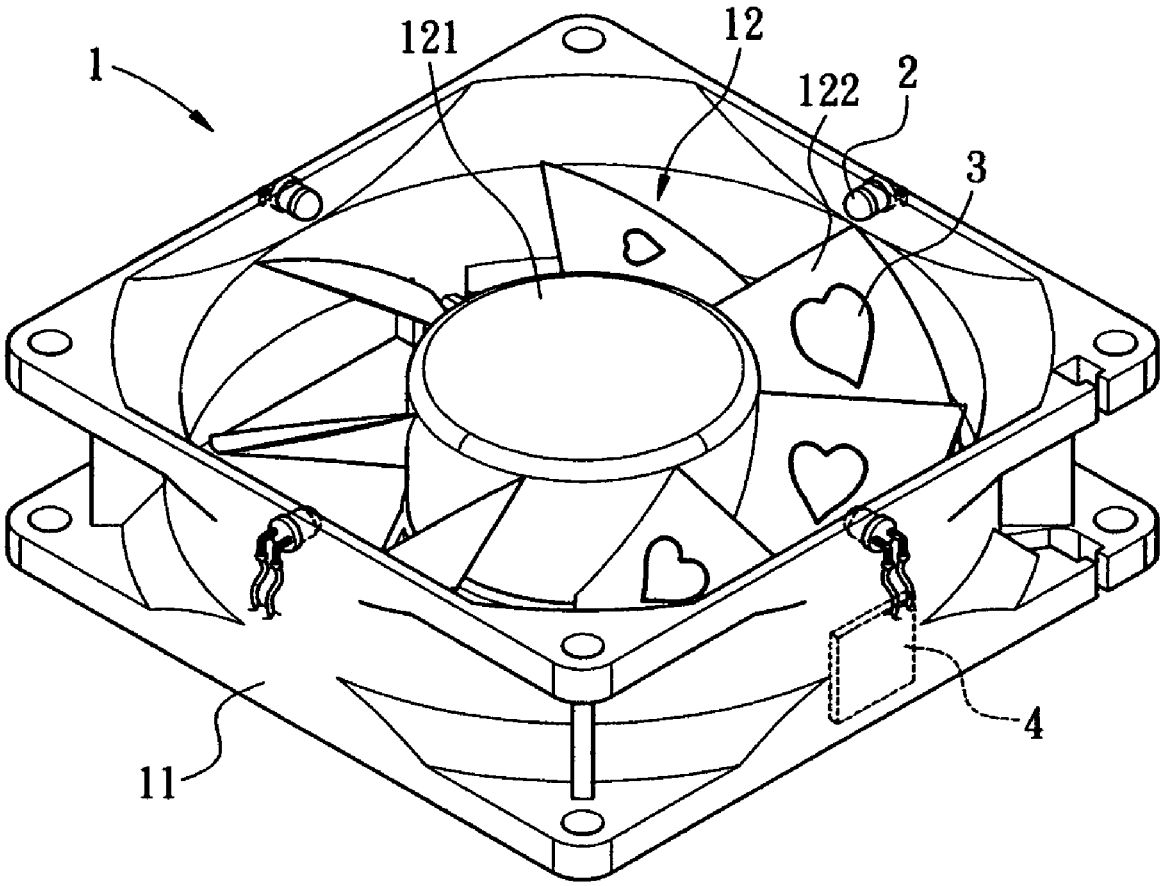
FIG. 1 is a schematic view showing the structure of the present invention.

FIG. 1 is a schematic view showing the structure of the present invention. It can be seen that the present invention mainly comprises a fan 1 having a base 11. The base 11 is formed of a square body with a circular inside. The center of the base 11 is provided with a blade assembly 12 comprising a plurality of blades 121 and a rim 122. The plurality of blades 121 are made of opaque materials and connected to the rim 122 with an inclination. The front of the blades 121 are provided with images 3 including patterns or characters formed by attaching reflective labels, printing products, or pressing products. The image 3 is formed of identical or different patterns or characters. Further, the image 3 can be formed by molding or carving, and then reflective materials can be applied thereto. Each inner side of the base 11 is intermediately provided with a light-emitting element 2 (e.g. LED in this embodiment). Each light-emitting element 2 is electrically connected to a controlling unit 4 provided on the base 11. Each light-emitting element 2 is angled to directly irradiate the inclined front of the blades 121, thereby to face the position at which each image 3 is provided.

Figure 2:
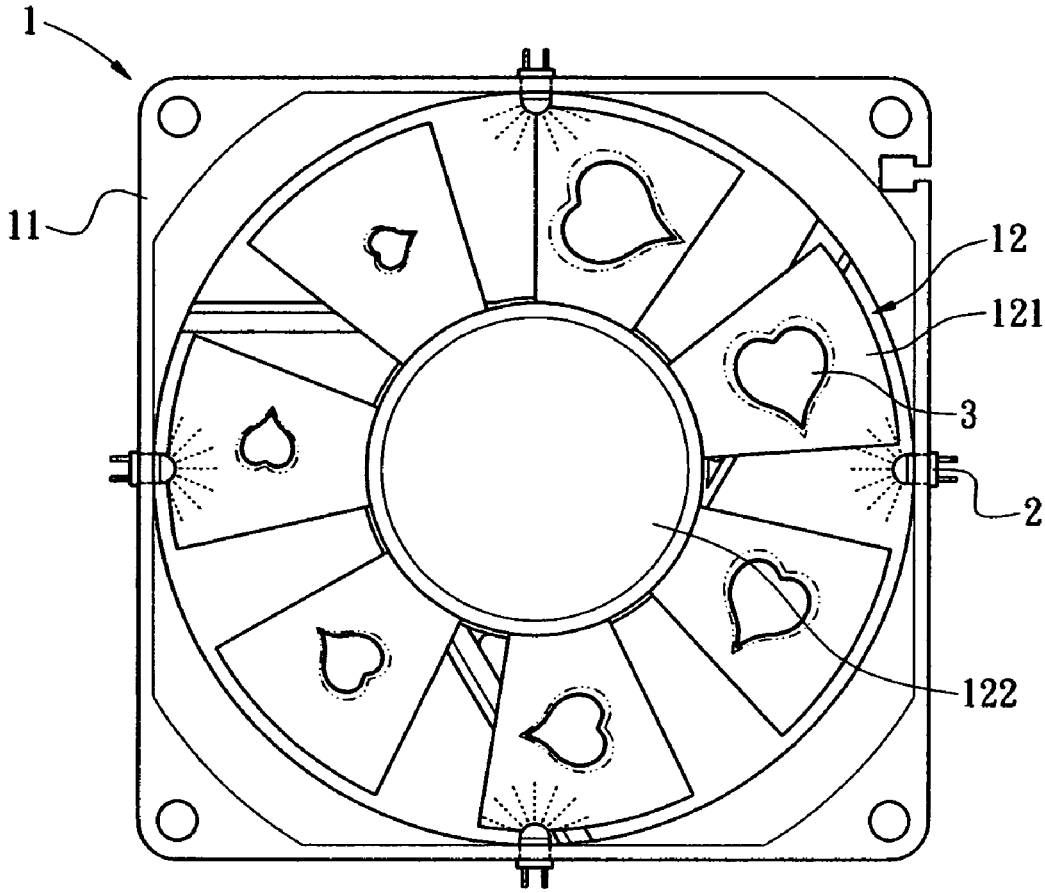
FIG. 2 is a schematic view showing the operation of the present invention.
Figure 3:
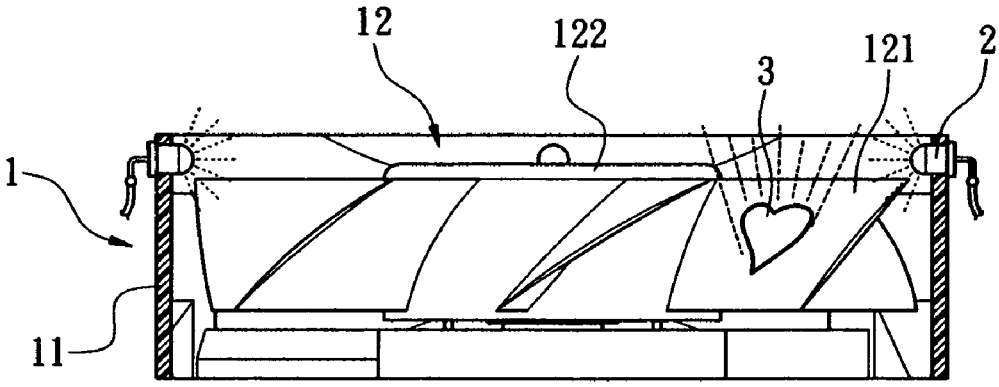
FIG. 3 is a side view showing the operation of the present invention.

FIGS. 2 and 3 are schematic views showing the operation of the present invention. When the blades 121 of the fan 1 are powered to rotate with a constant speed, at this time, the light-emitting elements 2 provided on all sides of the base 11 directly irradiate on the instantaneously passing blade 121 with the lightening frequency being synchronous with the rotation speed. After the images 3 provided on the blades 121 are irradiated, the shining effect of displaying the image 3 can be produced at the irradiating position by reflection. Further, the persistence of vision can be produced based on the image provided on each instantaneously passing blade 121. Alternatively, the lightening frequency of the light-emitting element 2 can be different from the rotation speed of the fan. When the same blade 121 rotates to pass each light-emitting element 2 at different positions, the light-emitting element 2 irradiates the image 3 provided on the blade 121, such that the irradiated image 3 can be displayed on the blade 121 by reflection, causing a shining effect in which the image 3 rotates with the blade 121.

Figure 4:
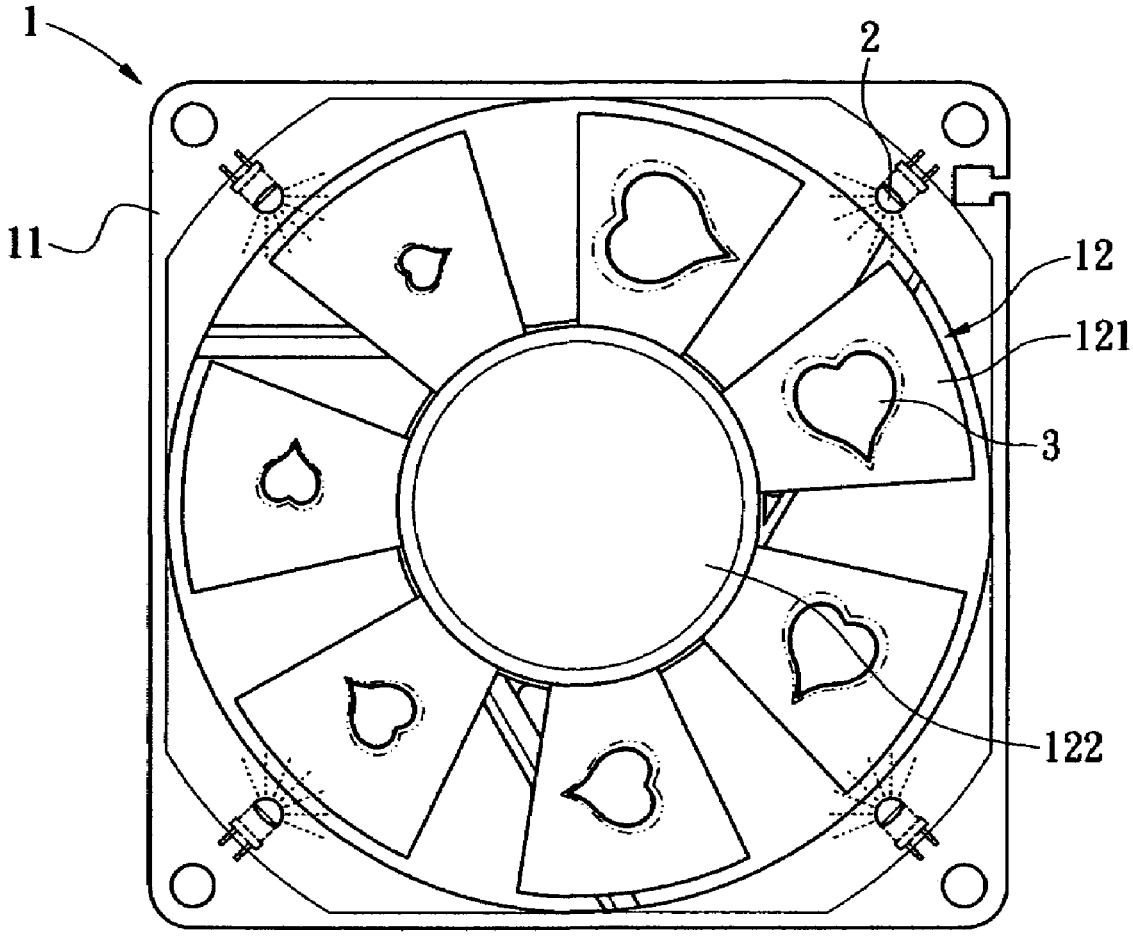
FIG. 4 is a top view showing the structure of a second embodiment of the present invention.
Figure 5:
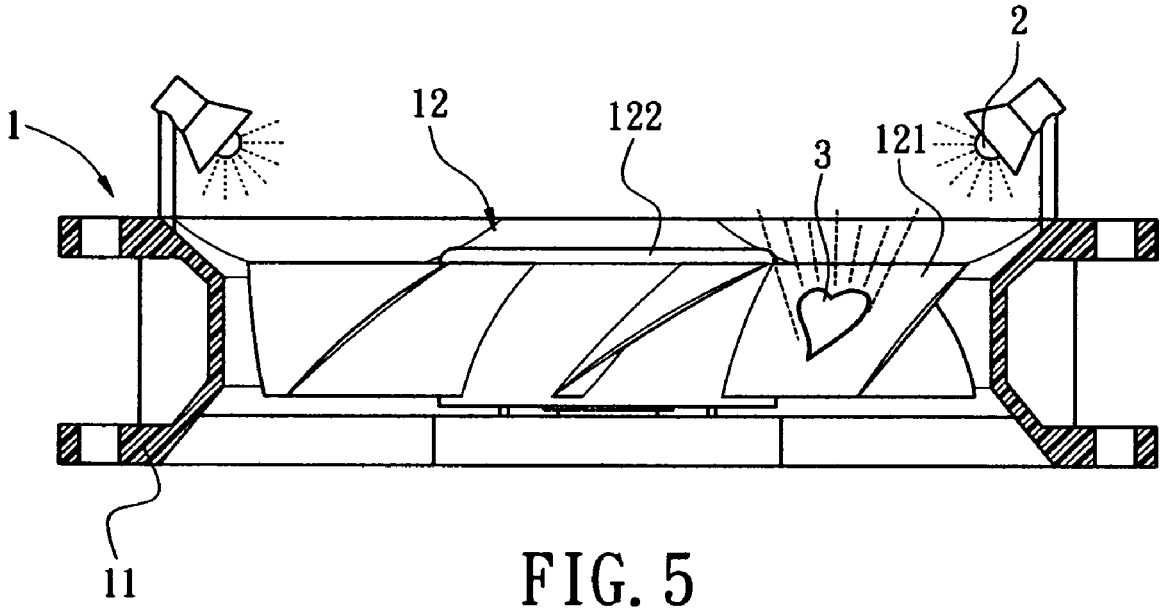
FIG. 5 is a schematic view showing the structure of a third embodiment of the present invention.

FIG. 4 shows a second embodiment of the present invention. It can be seen that four corners in the front of the fan base 11 are provided with light-emitting elements 2. Each light-emitting element 2 is electrically connected to a controlling unit (not shown). The light-emitting element 2 is angled to directly irradiate the inclined front of the blade 121, thereby to face the positions at which the images 3 are provided. The lightening frequency of the light-emitting element 2 is made to be synchronous with or different from the rotation speed of the fan 1. When the blade 121 rotates to pass each irradiating position of the light-emitting element 2 and the image 3 provided on the blade 121 is irradiated, owing to the reflective property of the image 3, a shining effect can be produced at the same position. Further, as shown in FIG. 5, in the second embodiment, the light-emitting elements 2 are erectly provided on four corners of the fan base 11, and each light-emitting element 2 directly irradiates the inclined front of the blade 121, thereby to face the position at which the image 3 is provided.

Figure 6:
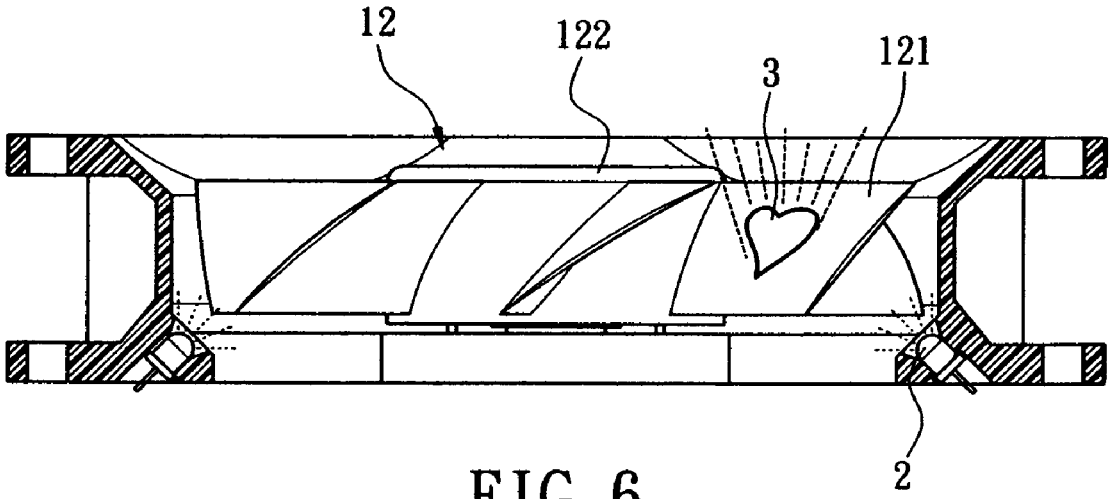
FIG. 6 is a schematic view showing the structure of a fourth embodiment of the present invention.

FIG. 6 is a schematic view showing the structure of a fourth embodiment of the present invention. Each corner of the fan base 11 is embedded with a light-emitting element 2. Each light-emitting element 2 is angled to directly irradiate the back of the blade 121. Further, the blades 121 are made of transparent or translucent materials, and provided with identical or different images 3. When the fan 1 is powered and rotates with a constant speed, the light-emitting element 2 provided on each corner of the base 11 irradiates the image 3 provided on the blade 121 with the lightening frequency being synchronous with or different from the rotation speed, such that a shining effect can be produced to display the image 3 by refraction and transmission of the light.

Although the present invention has been described with reference to the foregoing preferred embodiment, it will be understood that the invention is not limited to the details thereof. Various equivalent variations and modifications can still be occurred to those skilled in this art in view of the teachings of the specification and claims of the present invention. Thus, all such variations and equivalent modifications are also embraced within the scope of the invention as defined in the appended claims.

What is claimed is:

1. A shining fan structure for displaying images, comprising:

a fan having a base and a plurality of blades, the blades of the fan provided with images;

a controlling unit; and at least one light-emitting element provided on the fan base and electrically connected to the controlling unit, wherein the controlling unit controls the lightening frequency of the light-emitting element to be synchronous with or different from the rotation speed of the fan, and the light-emitting element is angled to directly irradiate the images provided on the blades.

2. The shining fan structure for displaying images according to claim 1, wherein the plurality of blades are made of transparent or translucent materials.

3. The shining fan structure for displaying images according to claim 1, wherein the images include patterns or characters.

4. The shining fan structure for displaying images according to claim 1, wherein the images are formed by any one of labels, printing products or pressing products.

5. The shining fan structure for displaying images according to claim 4, wherein the images are reflective or pervious to light.

6. The shining fan structure for displaying images according to claim 1, wherein the images are formed by molding or carving.

7. The shining fan structure for displaying images according to claim 6, wherein the images are reflective or pervious to light.

8. The shining fan structure for displaying images according to claim 1, wherein the light-emitting elements are intermediately provided on all sides of the base.

9. The shining fan structure for displaying images according to claim 1, wherein the light-emitting elements are provided on four corners of the front of the base.

10. The shining fan structure for displaying images according to claim 1, wherein the light-emitting elements are erectly provided on four corners of the front of the base.

11. The shining fan structure for displaying images according to claim 1, wherein the light-emitting elements are embedded in four corners of the base.

12. The shining fan structure for displaying images according to claim 1, wherein the controlling unit is provided on the fan base.

13. The shining fan structure for displaying images according to claim 1, wherein the light-emitting elements are light-emitting diodes.

* * * * *